United States Patent [19]

Schmidt

[11] Patent Number: 4,725,324

[45] Date of Patent: Feb. 16, 1988

[54] METHOD OF MAKING A THERMAL BARRIER CONSTRUCTION ELEMENT

[75] Inventor: Dietrich F. Schmidt, Etters, Pa.

[73] Assignee: Capitol Products Corporation, Mechanicsburg, Pa.

[21] Appl. No.: 889,205

[22] Filed: Jul. 25, 1986

[51] Int. Cl.[4] ..... B32B 31/06

[52] U.S. Cl. ..... 156/242; 156/304.1; 156/304.2; 156/304.3; 49/DIG. 1; 52/404

[58] Field of Search ..... 156/242, 304.1, 304.2, 156/304.3, 306.6, 313; 49/DIG. 1; 29/155 R, 455 LM, 458, 463, 469, 524; 52/403, 404

[56] References Cited

U.S. PATENT DOCUMENTS

| | | | |
|---|---|---|---|
| 3,556,917 | 2/1966 | Eakin et al. | 264/261 |
| 4,185,439 | 1/1980 | Bischlipp et al. | 264/261 |
| 4,267,673 | 5/1981 | Coulston | 49/DIG. 1 |
| 4,349,495 | 9/1982 | Mühle | 49/DIG. 1 |
| 4,358,489 | 11/1982 | Green | 428/40 |
| 4,494,348 | 1/1985 | Kastelic | 52/404 |
| 4,562,675 | 1/1986 | Baigas et al. | 52/404 |
| 4,581,089 | 4/1986 | MacMillan | 264/465 |
| 4,635,423 | 1/1987 | Ward | 52/404 |

FOREIGN PATENT DOCUMENTS

| | | | |
|---|---|---|---|
| 0131279 | 1/1985 | European Pat. Off. | 52/DIG. 1 |
| 0146529 | 6/1985 | European Pat. Off. | 52/405 |
| 2531221 | 3/1977 | Fed. Rep. of Germany | 49/DIG. 1 |
| 2831573 | 1/1980 | Fed. Rep. of Germany | 52/730 |
| 3107725 | 6/1982 | Fed. Rep. of Germany | 52/DIG. 1 |
| 132336 | 10/1979 | Japan | 52/730 |
| 2060750 | 5/1981 | United Kingdom | 49/DIG. 1 |
| 2074222 | 10/1981 | United Kingdom | 52/DIG. 1 |
| 2123468 | 2/1984 | United Kingdom | 52/DIG. 1 |

*Primary Examiner*—Caleb Weston

*Attorney, Agent, or Firm*—Donald L. Johnson; John F. Sieberth

[57] ABSTRACT

A method of forming a dual thermal barrier hollow wherein separate metal shapes are joined together with a non-conductive adhesive tape and a thermal barrier material is poured into receiving channels suitably formed by the joining of the two metal shapes, and upon hardening of the thermal barrier material, a dual thermal barrier hollow having structural integrity is formed.

10 Claims, 5 Drawing Figures

METHOD OF MAKING A THERMAL BARRIER CONSTRUCTION ELEMENT

BACKGROUND OF THE INVENTION

The present invention relates to a method of making a unitary construction element having a dual thermal barrier or thermobreak therein, commonly referred to as a thermal barrier extrusion, which can be employed in construction of windows, doors, frames therefor, and the like.

The invention generally relates to a method of making or forming dual thermal barrier hollows, especially dual thermal barrier hollows wherein the thermal barrier material is poured into a receiving channel or area in an extrusion.

The invention particularly relates to a method of forming a dual thermal barrier hollow or unitary construction element wherein two separate aluminum solid extrusions are joined together by a poured polyurethane resin or the like to form a single dual thermal barrier hollow.

With the advent of metal construction used in making windows, doors, frames therefor, curtain walls and the like, problems of heat conduction and water condensation have arisen. The use of aluminum or other metals has caused a greater transfer of heat between wall elements than had heretofore taken place in earlier types of construction. To solve this problem, some type of insulating or thermal break construction is essential. Accordingly, a variety of thermal barrier or thermobreak constructions and methods and apparatuses for making such constructions have been developed.

One type of construction which has achieved some degree of success is one in which the insulating material is poured, flowed, foamed, or formed in place. U.S. Pat. Nos. 3,204,324; 3,332,170; 3,393,487; 3,624,885 (Re. 28,084 and Re. 28,086); 3,634,565; and 3,823,524 are illustrative of such types of construction. Of these, 3,204,324 is representative of a method of making a thermal barrier construction element or insulating construction, wherein a metal shape having a generally U-shaped channel therein is filled with a flowing resinous insulating composition; the composition is cured, and subsequently a portion of the metal member or web forming the base of the channel is removed. U.S. Pat. No. 3,823,524 relates to a similar method but employs a web member which extends convexly between the structural member forming the channel. Both of these methods require the use of a liquid resinous composition which is subsequently cured or hardened. U.S. Pat. No. 3,393,487 discloses a somewhat more complicated process for making a thermal insulating joing construction and also utilizes a liquid plastic material. In such process, two separate elongated metal shapes are spaced apart and fastened together with a solid first insulating member. The two shapes and the first insulating member provide a channel in which a second thermal insulating member is flowed therein. Upon solidification of the latter, the metal and insulating members are locked together as an integral unit.

Of the more common types of thermal barrier constructions, two metal members are joined together by a solid insulating member. These constructions encompass a wide variety of insulating and/or plastic shapes and metal shapes. Illustrative of these are U.S. Pat. Nos. 2,835,360; 3,093,217; 3,099,337; 3,289,377; 3,436,884; 3,487,580; 3,600,857; and 3,916,503. In one of the more basic of this type of construction, for example, in U.S. Pat. No. 2,835,360, two metal members are joined together and spaced apart by an overlapping insulating member. In 3,916,503, simple mechanical means are employed to join the metal members with an insulating member. U.S. Pat. No. 3,600,857 is representative of more complex shapes of insulating and metal members.

In a particular type of the foregoing more common type of thermal barrier constructions, metal and insulating members are mechanically joined together by deformation of the metal members or by crimping or stitching the metal members on the insulating member. Representative of such a joining method are U.S. Pat. Nos. 3,114,179; 3,411,995; 3,420,026; 3,517,472; and 3,903,217 and Swiss patent No. 320,988 (same as British patent No. 768,499). For example, U.S. Pat. No. 3,420,026 discloses several types of thermal insulating members and methods of making them. In one type, two separate metal members are mechanically joined to a central insulating member by crimping or deformation of groove means or projections on the metal members. In one particular type of thermal break construction, the insulating member is in the shape of a Maltese cross in cross-section. In another embodiment, the insulating member is made from a thermoplastic material and a portion thereof is heated to cause melting and flow of the plastic into an associated groove means formed by the two metal members. Upon cooling of the plastic, the metal and plastic members are unitarily joined together. U.S. Pat. No. 3,517,472 also illustrates a mechanical joining process similar to that of the former and additionally represents the use of a plastic or insulating member which expands upon heating. The Swiss patent discloses several types of window or door frames, one of which employs a crimp system using two separate metal extrusions having a pair of flanges thereon which form grooves for receiving a plastic rod. After the plastic rod or thermal barrier member is introduced into the grooves, the flanges are pressed towards the plastic rod or crimped thereon so that they are flush with the sides of the rod.

Other types of thermal break or insulated window or wall constructions are illustrated by U.S. Pat. Nos. 2,654,920; 3,055,468; 3,289,377; 3,411,254; and 3,446,801. For example, U.S. Pat. No. 3,411,254 provides a plastic thermobreak which utilizes a plastic locking strip which contains a heat actuated blowing agent to join two separate metal shapes. After assembly of the two metal shapes and the plastic strip, the unit is heated to expand the plastic into tight engagement with the two metal members.

More recent types of thermal barrier construction methods are illustrated by U.S. Pat. Nos. 3,815,216; 3,916,503; 3,925,953; 3,992,769; 4,079,496; 4,151,682; and 4,188,705.

U.S. Pat. No. 3,815,216 employs a metal extrusion which has a removable interior section which is subsequently removed to separate the extrusion into two metal members. While maintaining the separate metal members spaced apart, a plastic material is inserted therebetween. The construction element can be made in a continuous operation.

In U.S. Pat. No. 3,916,503, lineal shapes are extruded to accept an insulating barrier previously formed in such a shape as to fit the lineal shapes. The insulating barrier is joined with the lineal shapes by mechanical means.

U.S. Pat. No. 3,925,953 discloses a method wherein two metal members are joined together by a plastic clamp and held apart by a plastic wedge.

U.S. Pat. No. 3,992,769 describes a method wherein a metal shape is extruded in a normal manner and the insulating member is crimped in position in the metal extrusion and a portion of the metal extrusion is subsequently removed.

U.S. Pat. No. 4,079,496 discloses a method wherein a pair of lineal metal shapes are aligned in a spaced apart relation and the insulating member has small lineal projection thereon which are shaved off to provide a tight or interference fit, when the insulating member is inserted between the metal shapes so as to join them together.

U.S. Pat. No. 4,151,682 discloses a thermal barrier window construction wherein centered rigid extended plastic shapes are included in the window frame.

U.S. Pat. No. 4,188,705 illustrates a crimping or stitching apparatus. In such a crimping system, rollers are normally used to provide crimping of the metal flanges on the insulating or plastic member. Conventionally, two rollers or wheels are required to crimp the flanges. One roller bends the metal flanges on the insulating member while the other roller backs up or holds the metal extrusion in the correct position for joining metal and plastic members. To accomplish the crimping action, clear access must be available on both sides of the plastic members on which crimping of the metal members occurs. In some cases, a small wheel or support is laterally employed to serve as a back-up. The size of the support and the forces required to obtain a tight joint create a number of operating problems. The types of shapes or extrusions which can be used in this method are limited.

Large window shapes such as mullions, rails and sills used in thermally insulated windows often require two separate thermal barriers to maintain structural integrity. The present invention provides hollow shapes which cannot be readily debridged or separated because of their geometry.

The present invention provides a number of advantages over prior art constructions namely in that solid extruded shapes can be quickly and easily joined together to form a poured urethane dual thermal barrier construction element having structural integrity.

It is a primary object of the instant invention to provide a relatively simple method of making a dual thermal barrier hollow utilizing solid lineal shapes or extrusions.

Other objects and advantages of the present invention will become more readily apparent from a consideration of the description and drawings hereinafter.

SUMMARY OF THE INVENTION

Dual thermal barrier hollow extrusions are formed by extruding separate aluminum or metal shapes and joining the shapes together with a non-conductive adhesive tape and then pouring polyurethane or other suitable plastic into a receiving area formed by the joining of the metal members to complete the thermal barrier.

DESCRIPTION OF THE PREFERRED EMBODIMENTS

Figure 1:
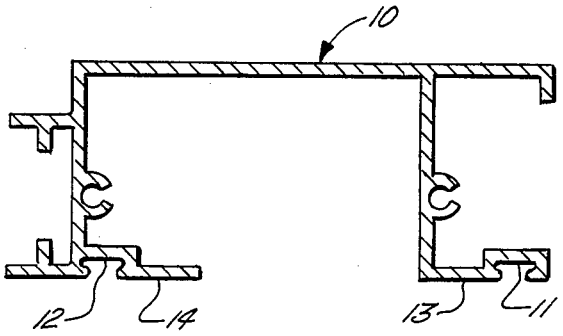
FIG. 1 is a view in cross-section illustrating a solid frame member or lineal extrusion which may be used in forming one-half of a dual thermal barrier hollow.
Figure 2:
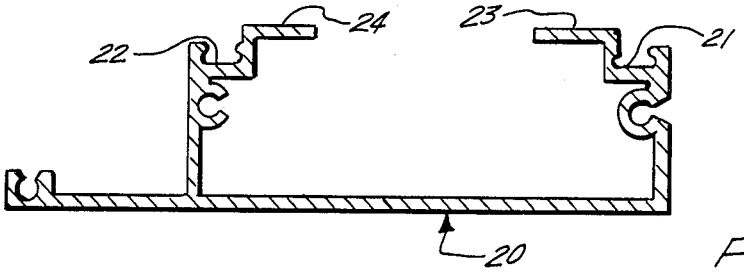
FIG. 2 is a view in cross-section illustrating a solid frame member or lineal extrusion which may be used in forming the other one-half of a dual thermal barrier hollow.

Referring now to the drawings, FIGS. 1 and 2 illustrate preferred embodiments of the lineal shapes or extrusions used in constructing the dual thermal barrier hollow of the invention. Two solid lineal shapes or extrusions are prepared in a customary manner. The shapes may be prepared in a variety of configurations depending upon the particular end use. It is important though that the shapes be so constructed that they can be joined together as will be explained in more detail hereinafter.

An interior sill or lineal shape 10 is illustrated in FIG. 1. A matching exterior sill or lineal shape 20 is illustrated in FIG. 2. Each of the shapes is somewhat rectangularly shaped in cross-section with one side of the rectangle open so that when the two shapes are placed adjacent each other as shown in FIG. 3, a hollow 30 is formed.

The interior sill 10 has thermal barrier receiving channels 11 and 12 on each side thereof. The exterior sill 20 also has thermal barrier receiving channels 21 and 22 on each side thereof. Adjacent each channel 11 and 12 and interiorly thereof, is a tape receiving surface or edge 13 and 14, respectively. Adjacent each channel 21 and 22 and interiorly thereof, is a tape receiving surface or edge 23 and 24, respectively.

Figure 3:
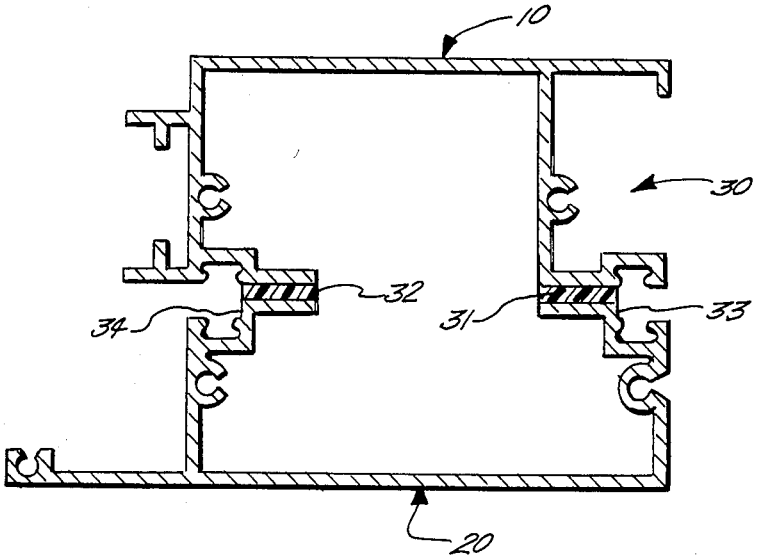
FIG. 3 is a view in cross-section illustrating the positioning or adhesively joining of the frame members or lineal extrusions of FIGS. 1 and 2 for forming the dual thermal barrier hollow.

Shapes 10 and 20 are positioned adjacent each other as illustrated in FIG. 3 and attached or joined to each other by means of a dual faced non-conductive adhesive tape 31 and 32. An adhesive backed cellular neoprene tape is preferred, but any other similar tape may be used. Tape thickness is preferably identical to the thermal barrier thickness, i.e. separation of inside to outside metal. The tape itself offers no structural integrity of the final hollow as seen in FIG. 4, but merely provides the means to hold the two shapes together before they are permanently joined to each other.

Once the members 10 and 11 are joined together to form the hollow 30 as in FIG. 3, it is seen that the smaller channels 11 and 21 and tape 31 form the larger channel 33 and smaller channels 12 and 22 and tape 32 form the larger channel 34. Channels 33 and 34 are each filled with a liquid thermal barrier material. A poured polyurethane is especially preferred as it not only binds the two shapes together after hardening, but also provides structural integrity to the hollow.

Figure 4:
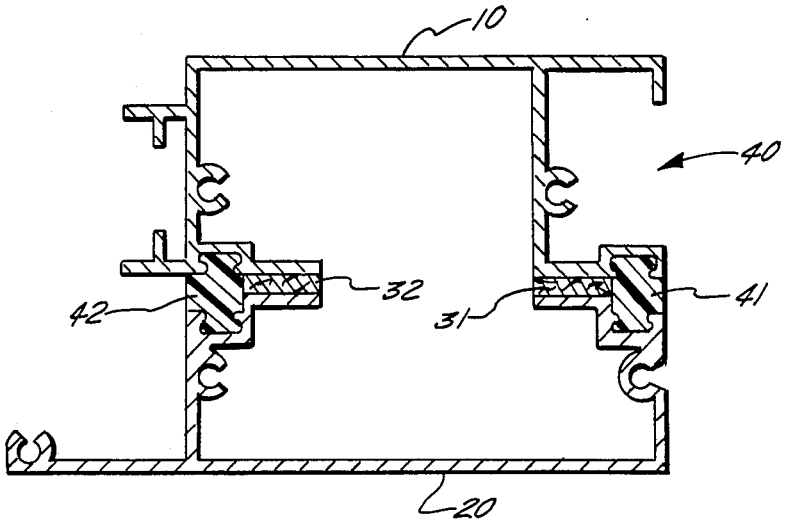
FIG. 4 is a view in cross-section similar to that of FIG. 3 illustrating the frame members adhesively joined together; and, FIG. 5 is a view in cross-section of a lineal hollow illustrating an alternate embodiment of a dual thermal barrier hollow.

After the thermal barrier material hardens, a hollow 40 as seen in FIG. 4, is formed which has dual thermal barriers 41 and 42. The tapes 31 and 32 also serve as a thermal barrier and remain in place, since they are under no separation strain. The thermal barrier material or poured urethane is equal to the interrupted metal wall in strength.

No special equipment is required to assemble the dual thermal barrier hollow of the invention. A set of angle brackets can be used in aiding the lamination of the metal shapes with the adhesive backed tape.

The method of the invention is applicable to use with a variety of shapes with proper positioning of tape surfaces.

The invention is especially suitable for use with aluminum extrusions, but can be used on windows constructed of other materials, e.g. rolled steel.

Figure 5:
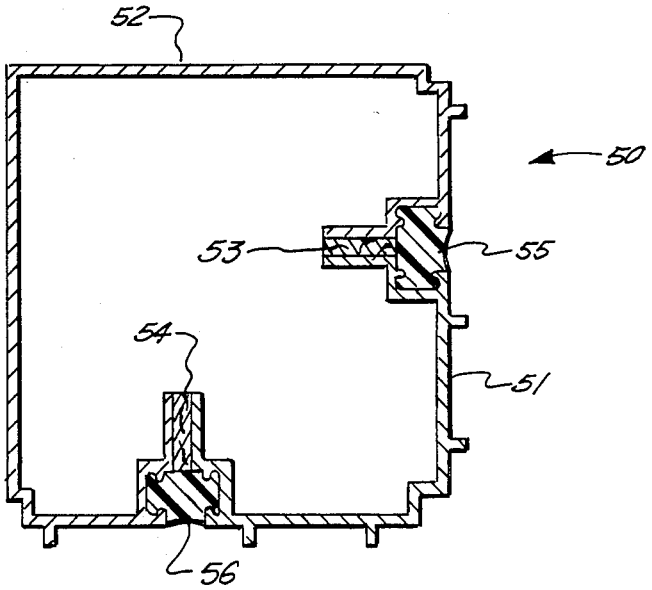

FIG. 5 illustrates a corner mullion made by the method of this invention. Hollow 50 is made up of an interior mullion 51 and an exterior mullion 52. Assemblying non-conductive adhesive tapes 53 and 54 and poured thermal barrier plastics 55 and 56 provide the dual thermal barrier of the hollow 50.

The present invention completely eliminates the need for debridging of metal to form a thermal barrier and provides a relatively simple method of forming dual thermal barrier hollows.

The foregoing disclosure and description of the invention is only illustrative and explanatory thereof and various changes in the size, shape and materials, as well as in the details of the illustrated construction or procedure, may be made within the scope of the appended claims without departing from the spirit of the invention.

What is claimed is:

1. A method of forming a dual thermal barrier lineal metal hollow comprising the steps of:

(a) aligning a pair of metal shapes adjacent each other in a spaced apart relationship, each of said metal shapes having a pair of spaced apart thermal barrier receiving channels and a tape receiving surface adjacent each channel;

(b) attaching the two metal shapes to each other in spaced apart relationship by means of a thermally insulative dual faced adhesive tape placed on the tape receiving surfaces of each of the metal shapes, said shapes being so attached to each other that a thermal barrier receiving channel of one shape is adjacent a thermal barrier receiving channel on the other shape and that the two thermal barrier receiving channels together and the tape adjacent thereto form a larger thermal barrier receiving channel, thereby forming two larger thermal barrier receiving channels spaced apart from each other; and (c) introducing a liquid thermal barrier material into each of the larger thermal barrier receiving channels, each tape helping to retain the liquid barrier material within the larger thermal barrier receiving channel defined in part by the tape, and upon hardening of the thermal barrier material within each larger thermal barrier receiving channel forming a dual thermal barrier hollow having structural integrity.

2. The method of claim 1 wherein the metal shapes are aluminum extrusions.

3. The method of claim 1 wherein the metal shapes are constructed of rolled steel.

4. The method of claim 1 wherein the adhesive tape is a dual faced adhesive backed cellular neoprene tape.

5. The method of claim 1 wherein the thermal barrier material is a poured polyurethane.

6. The method of claim 1 wherein the metal shapes are aligned and held in place by brackets.

7. The method of claim 1 wherein one metal shape is an interior sill and the other metal shape is an exterior sill.

8. The method of claim 1 wherein the hollow formed is substantially rectangularly shaped and the thermal barrier channels are directly opposite each other.

9. The method of claim 1 wherein the hollow formed is substantially rectangular and the thermal barrier channels are positioned on sides of the rectangle adjacent each other.

10. The method of claim 1 wherein the hollow formed is a corner mullion.

* * * * *